US006719326B2

(12) United States Patent
Schroth et al.

(10) Patent No.: US 6,719,326 B2
(45) Date of Patent: Apr. 13, 2004

(54) HARNESS BELT

(75) Inventors: Carl-Jürgen Schroth, Soest (DE); Paul Knight, Bracknell (GB)

(73) Assignee: Schroth Safety Products GmbH, Arnsberg (DE)

( * ) Notice: Subject to any disclaimer, the term of this patent is extended or adjusted under 35 U.S.C. 154(b) by 0 days.

(21) Appl. No.: 10/233,781

(22) Filed: Sep. 3, 2002

(65) Prior Publication Data

US 2003/0098575 A1 May 29, 2003

(30) Foreign Application Priority Data

Sep. 5, 2001 (DE) ..... 101 43 654

(51) Int. Cl.[7] ..... B60R 22/00
(52) U.S. Cl. ..... 280/801.1
(58) Field of Search ..... 280/801.1, 807, 280/808; 297/481, 484, 467, 468; 244/122 R, 122 B

(56) References Cited

U.S. PATENT DOCUMENTS 2,542,248 A * 2/1951 Heffernan et al. ..... 244/122 B
3,648,954 A * 3/1972 Gaylord et al. ..... 244/122 B
4,302,049 A * 11/1981 Simpson ..... 297/484
4,487,383 A * 12/1984 Mazelsky ..... 244/122 R
4,738,413 A * 4/1988 Spinosa et al. ..... 244/151 R
5,660,445 A * 8/1997 Murray ..... 297/485
6,179,329 B1 * 1/2001 Bradley ..... 280/801.1
6,367,882 B1 * 4/2002 Van Druff et al. ..... 297/484
6,446,910 B1 * 9/2002 Knoll et al. ..... 244/122 R

FOREIGN PATENT DOCUMENTS

DE 11 42 762 B 8/1963

* cited by examiner

*Primary Examiner*—Paul N. Dickson
*Assistant Examiner*—Faye M. Fleming
(74) *Attorney, Agent, or Firm*—Henry M. Feiereisen; Ursula B. Day

(57) ABSTRACT

The harness belt (1) comprises a dual pelvis belt (3), two shoulder belts (2) and two crotch belts (4). The belt segments (5) of the pelvis belts (3) as well as the shoulder belts (2) can be joined by means of belt tongue (9, 8) to a belt buckle (7) wherein the crotch belts (4), by means of the buckle proximate loops (15) surround the belt tongues (9) of belt segments (5) of pelvis belt (3), and are secured in circumferential direction against movement relative to the belt buckle (7) and wherein belt tongues (9) are configured with recesses (11) adapted for the belt tongues (9) in belt buckle (7). The loops (15) are connected to the buckle proximate ends (20) of the crotch belts (4) at an obtuse angle.

7 Claims, 1 Drawing Sheet

HARNESS BELT

BACKGROUND OF THE INVENTION

The invention refers to a harness belt for racing cars wherein the harness belt is provided with a dual pelvis belt, shoulder belt and two crotch belts, wherein the belt segments of pelvis belts as well as the shoulder belts are joined by means of belt tongues to a belt buckle and the crotch belts are secured at their buckle proximate ends indirectly to the belt buckle.

Harness belts are personal restraining systems, and when used in racing cars typically have a dual pelvis belt, two shoulder belts and two crotch belts, which directly or indirectly merge into a central buckle (product list of the Schroth Safety Products GmbH, Im Ohl 14, 50714 Amsberg "Weight and price Comparison for Open Wheel Racing Harnesses").

Thus, the crotch belts can be attached to a T-shaped fitting (Profi III-6 and Profi II-6), which is slipped from below into the corresponding receptacle of the belt buckle. By providing a distance relative to the points of attachment of the crotch belts to the T-shaped bracket, it is intended that the crotch belts laterally bear against the thighs of a driver to thereby reduce the danger of injuries to the genital area.

Such T-shaped fittings, extending downwardly from the belt buckle cannot always be kept in the optimal position relative to the driver, and it is possible that the T-shaped fitting ends come in contact with the thighs. This leads not only to discomfort, but in an accident, when the legs of the driver are yanked upwards during the rebound phase, also leads to injuries. In this context, it is known in the field that during an accident, such T-shaped fittings can deform by bending upwards into a U-shape so that the opening lever of the belt buckle, which, according to regulations of the racing sport organization FIA, must point in downward direction, is now substantially hindered in its free motion so that the belt buckle can no longer be opened.

In addition, such a T-shaped fitting can prevent an unrestricted gliding through openings that are designed for this purpose at seats configured as so-called "extrication seats". These types of seats restrain their drivers after an accident in a fixed position and thus stabilized together with the seat, they can be removed from the racing vehicle in a manner that is gentle to the spine.

As part of the prior art, an embodiment of a harness belt is known having a dual pelvis belt, shoulder belts and crotch belts (profi III-6 F and profi II-6 F) wherein the crotch belts run across the thighs of a driver and are each guided through D-shaped rings attached to the belt segments next to the belt tongues and which run from these rings obliquely upwards past the belt buckle into the area of the belt tongues of the shoulder belts. At their buckle proximate ends, the crotch belts are provided with loops through which the belt tongues of the shoulder belts are placed and then locked into the belt buckle.

However, such an embodiment requires that the length of the belt tongues of the shoulder belts must be longer by at least the width of the loops, which are disposed end-proximate to the crotch belts, as would be required for locking the shoulder belts with the belt buckle. As a result, such elongated belt tongues are very uncomfortable for the driver of the racing vehicles: since he is generally seated in a crouched position, in particular when racing Formula 1 racing vehicles, because they can press onto the lower costal arches of the driver. In addition, no direct flow of strength from the shoulder belt via the belt buckle into the crotch belts is realized. Moreover, when applying any weight, the belt buckle is pulled upwardly. Also, the belt segments of the pelvis belt can glide in relation toward the crotch belts redirected via the D-shaped rings, whereby a correct positioning of the driver can be realized only to a limited extent. An upward pull of the belt buckle causes an extension of the shoulder belts, which in turn results in a) the driver not being optimally secured by the belt and b), in case of an accident, a pronounced forward shift of the driver's body and thus, the danger of a heavier head impact and faster acceleration of the head and chest, cannot be prevented.

From the DE-PS 1 142 762 a belt arrangement for an aircraft seat, especially for a pilot seat, is known. There it is taken into account that the pilot can take up various spatial positions in conjunction with the aircraft, as well as the situation wherein the pilot must be able to separate from the belt arrangement, in case he will be ejected from the aircraft and subsequently, when hanging from the parachute by means of additional belts, has to be carried safely to the ground. Furthermore, when the aircraft is on the ground, the pilot should be able to leave the aircraft in a normal way.

For this purpose, the belt arrangement is provided with a pelvis belt having dual belt segments, which are joined with the belt buckle via belt tongues and from which they can be also separated again.

The ends of the belt segments facing away from the belt tongues are placed via additional belt tongues, through vertical slots, into brackets that are attached to the pilot seat. In order to secure the belt tongues to the brackets, bolts that are guided through bores in the belt tongues are disposed at the rear side of these brackets. The bolts can be separated from the belt tongues by way of either manual or automatic action, upon ejecting the pilot seat holding the pilot from the airplane.

Loops, which are slid over the belt tongues form a portion of the belt segment of an essentially Y-shaped crotch belt. The belt segments, which are redirected through the brackets run between the buttocks of the pilot and the surface of the pilot seat and are guided into a circular control element which is seated within a recess and extends parallel to the front face of the pilot seat, from where only a shank portion still extends between the thighs of the pilot and runs obliquely in rearward direction relative to the belt buckle. A hand lever is also placed within the recess for activation of the ejection mechanism.

In the embodiment of FIG. 4, the shank portion can be coupled directly to the belt buckle via a belt tongue.

In the embodiment of FIGS. 2 and 3, two loops of V-shaped configuration are provided at the end of the shank portion near the belt buckle, for sliding over the ends of the belt segments of the pelvis belt. Then, the belt tongues can be coupled to the belt buckle The assembly of the known belt arrangement is adapted to the requirements that a pilot, on the one hand, has to be held securely in the pilot seat in all positions and during all motions of the aircraft, and on the other hand, he must be able to release himself from the pilot seat when leaving the aircraft in a normal manner, or in an air emergency when the pilot seat is ejected from the aircraft, must be able to separate himself from the pilot seat When exiting the aircraft on the ground in a normal manner, the pilot needs to open only the belt buckle so that the shoulder belts, the belt segments of the pelvis belt and the crotch belt are released from the body of the pilot.

In an emergency, that is, when the pilot seat is ejected from the aircraft, the bolts are separated manually or automatically from the belt tongues of the belt segments of the pelvis belt, so that the stops for the belt segments of the pelvis belt and the belt segments of the crotch belt fall away and the pilot can separate unencumbered from the pilot seat.

During the various movements of the airborne aircraft, the type of accelerations that act on the pilot seat are essentially those that press the pilot into the pilot seat. In other words, during these movements of the aircraft, no considerable forward motions of the pilot relative to the pilot seat occur. Accordingly, only a single crotch belt is provided which, according to embodiments of FIGS. 2 and 3, turn into dual loops near the belt buckle and surround the buckle proximate end of the pelvis belt. It is thus important that the loops of the crotch belt shank—relative toward the belt buckle—are arranged at an angle, that is greater than 180 C.

During the various movements of the airborne aircraft, the type of accelerations that act on the pilot seat are essentially those that press the pilot into the pilot seat. In other words, during these movements of the aircraft, no considerable forward motions of the pilot relative to the pilot seat occur. Accordingly, only a single crotch belt is provided which, according to embodiments of FIGS. 2 and 3, turn into dual loops near the belt buckle and surround the buckle proximate end of the pelvis belt. It is thus important that the loops of the crotch belt shank—relative toward the belt buckle—are arranged at an angle, that is greater than 180 degrees.

It is further shown, in particular, in accordance with FIGS. 2, 3 and 4 that the shank of the crotch belt bears flat between the thighs of the pilot and extends in upward direction and obliquely rearwards to the belt buckle.

SUMMARY OF THE INVENTION

Starting with the prior art as a basis, it is an object of the invention to provide a harness belt for racing vehicles which avoids the afore-stated drawbacks of the prior art.

This object is solved in accordance with the present invention by providing a harness belt for a racing vehicle provided with a dual pelvis belt, shoulder belt and to crotch belts, wherein the belt segments of pelvis belts as well as the shoulder belts) are joined by means of belt tongues to a belt buckle and the crotch belts are secured at their buckle proximate ends indirectly to the belt buckle, characterized in that the crotch belts, at their buckle proximate ends are connected with loops under an obtuse angle open towards the belt buckle, and surround the insertable belt tongues which are secured against movement in circumferential direction, of belt segment of pelvis belt the belt tongues of segment lengths of catch ends are configured in triangular shape the recesses in belt buckle are adapted to this configuration, the belt tongues of segment lengths, between the free catch ends and braces with the segment lengths have a stepwise configuration and taper in the direction of the brace ends, wherein the belt tongues of the belt segments are sewn into the ends of the respective belt segments via extensions in a tilt-and rotationally fixed manner.

Accordingly, the crotch belts are now held directly by the belt segments of the pelvis belts. For this purpose, the ends of the crotch belts adjacent to the belt segments of the pelvis belts are provided with loops, which are slid over the belt tongues prior to inserting the belt tongues. Thereafter, the belt tongues of the belt segments can be inserted into the corresponding recesses in the belt buckle for locking into place.

An advantage of this arrangement is that the belt tongues of the shoulder belts need no longer be lengthened and accordingly do not cause discomfort to the driver of a formula-racing vehicle. Also, the direct flow of strength from the shoulder belts via the belt buckle and the belt tongues of the belt segments of the pelvis belts into the crotch belts are realized. The driver can be firmly secured to his seat without any problems, so that even in case of an accident, an unwanted jerking forward of the head and the chest cannot occur. Furthermore, the crotch belts are guided free of obstructions along the thighs, to thereby prevent even the danger of injuries to the genital area. Principally, an impairment of function of the belt buckle, in particular after an accident, is thus avoided.

A further essential part of the invention is the insertion of the belt tongues of the belt segments of the pelvis belt into the belt buckle so that they are secured against movement. A circumferential twisting of the belt tongues, that is, in direction parallel to the body surface relative to the belt buckle is thereby prevented. By securing the position of the belt tongues in this manner a direct transmission of strength from the shoulder belts into the crotch belts is realized.

The belt tongues of the belt segments of the pelvis belt are configured in triangular shape and the recesses in the belt buckle are adapted to this configuration. During an accident, the shift of force initiation traveling through the shoulder belts and the deflection of the force through the crotch belt, generates such lever effects, that the belt buckle in conjunction with the belt tongues of the belt segments of the pelvis belts are configured for absorption of the so generated lever effects by the recesses in the belt buckle.

In addition, as shown in FIG. 2, the belt tongues 9 have a stepwise configuration in the area 13 between the catching ends 10 and the brace 14 so that the loops 15 are kept away from belt buckle 7 and the belt tongues 9 can bear closely to the contour of the user's body 6.

Until now, there was the danger that the loops of the crotch belt, which are slid onto the belt tongues of the belt segments of the pelvis belts are caused to slide down when the belt tongues are twisting downwardly, or that the ends of the catch either cannot be inserted into the belt buckle at all or can be inserted for locking only under difficult conditions. This drawback is now avoided in that the belt tongues are configured so that they are easily gripped in a stable manner and held on the tongues by suitably configured loops. This is realized, in particular due to the belt tongues having a tapered configuration in direction facing away from the buckle. The advantage of this configuration is that under stress the belt loops tend to pull away from their belt buckle and thereby do not interact with the belt buckle.

A crash with a racing car involves significant longitudinal lags, during which the driver slides forward into the belts. This process causes stress to the pelvis belt, the shoulder belt and indirectly also to the crotch belts. For this reason, it is desirable for dual crotch belts to bear flatly against the thighs so that they can move into to groin area in order to protect the genital area. Furthermore, such crotch belts, following along a tangential line extending from the chest area to the groin area, are to be fastened below the driver or also fastened further rearwardly.

Thus, the crotch belts according to the invention are configured in such a way that, beginning from an imaginary centerline which extends vertically through the buckle, the loops are connected to the crotch belts at an angle of less than 180 C. In such an arrangement the crotch belts bear flatly against the thighs. Furthermore, these should not be secured to a brace which is positioned transverse to the driving direction, but should be secured to two individual braces positioned longitudinal to the vehicle at a distance to be defined. With this arrangement it is again emphasized that the crotch belt bears flat against the thigh.

In a racing car, a firmly tied belt is of decisive importance with respect to its restraining function. The same applies to the crotch belts. The pelvis belt tongues according to the invention are thus configured so that the loops, when sliding away from the buckle are caught at the tongues, even when all parts of the belt are pre-tensioned.

Especially when the crotch belts are pre-tensioned, there is the danger that the pelvis belt tongues, when inserting them with the crotch belts into the buckle, are twisting in a downward direction thereby causing the loops of the pelvis belt tongues to slide off from the pelvis belt tongues. For this reason, the pelvis belt tongues are sewn into the ends of the belt segments, so that they cannot twist away or would be able to twist away only under extensive stress forces.

Due to the features that the belt tongues of belt segments of the pelvis belts are provided with gripping recesses, insertion of the belt tongues into the belt buckle is considerably simplified.

BRIEF DESCRIPTION OF THE DRAWING

The invention is further described as follows by means of an example of an embodiment and as illustrated in the drawings.

It is shown.

DETAILED DESCRIPTION OF PREFERRED EMBODIMENTS

Figure 1:
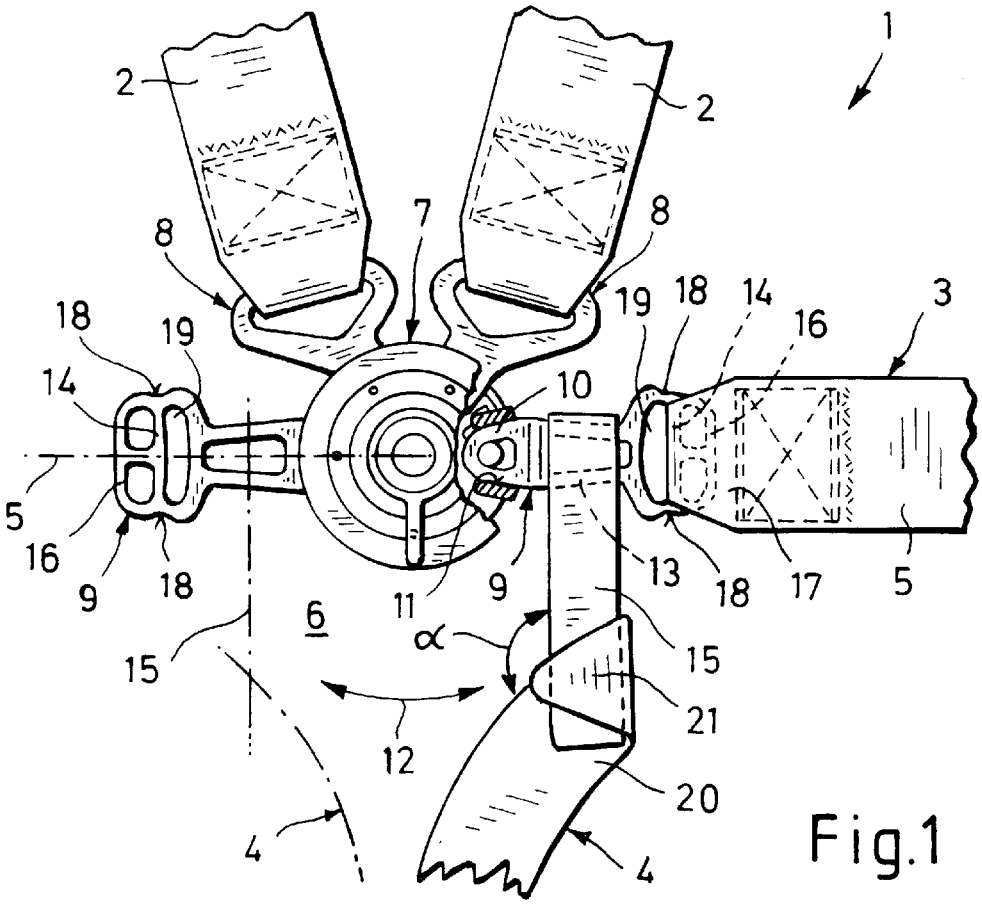
FIG. 1 is a front view of a partial section of a schematic illustration of a harness belt in the area of the belt buckle.

In FIG. 1, a harness belt is referenced with numeral 1, which is destined for a driver of a racing vehicle (formula vehicle).

This harness belt 1 comprises two shoulder belts 2, a dual pelvis belt 3, as well as crotch belts 4, from where the shoulder belts 2 and the belt segments 5 of the pelvis belts 3 are joined together in a belt buckle 7 located centrally in front of the body 6 of the vehicle occupant. The shoulder belts 2 show belt tongues 8.

The belt segments 5 of the pelvis belt 3 are provided with belt tongues 9 having catch ends 10 of triangular configuration, which are insertable into the recesses 11 of belt buckle 7 and adapted to recesses 11. Due to this configuration, a relative motion of belt tongues 9 of belt segments 5 in circumferential direction according to double arrow 12 relative to belt buckle 7, is prevented.

The belt tongues 9 of belt segments 5, in the area 13 between the catch ends 10 and the attachments 14 of belt tongues 9 at the belt segments 5 in direction towards the attachments 14, are configured in tapered configuration. This tapered configuration reduces the danger that during the insertion, the end proximate loops 15 of crotch belts 4 of the belt tongues 9 are able to slip partially or entirely downward.

The belt tongues 9 of belt segments 5 in the area of the brace 14, by means of extensions 16, are configured in such a manner that the belt tongues 9 are sewn into the ends 17 of belt segments 5 of the pelvis belts 3 so as to be substantially rotationally secured against twisting and tilting.

The belt tongues 9 of belt segments 5 are provided with recessed grips 18 in the area of brace 14, in order to facilitate the insertion of the catch ends 10 into the belt buckle 7.

Furthermore, the belt tongues 9 are configured with slots 19 as a weight-reducing means, wherein the slots 19 in the area of brace 14 are ideally adapted to the characteristics of the maximal bending forces anticipated to bear on the brace 14.

Figure 2:
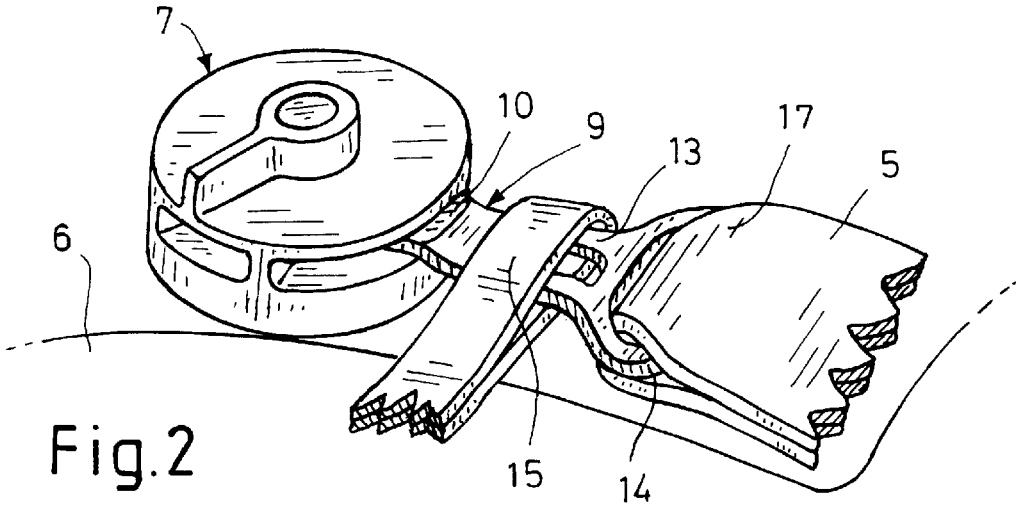
FIG. 2 is an enlarged perspective illustration of a belt buckle with locked in belt tongues.

In addition, as shown in FIG. 2, the belt tongues 9 have a stepwise configuration in the area 13 between the catching ends 10 and the brace 14 so that the loops 15 are kept away from belt buckle 7 and be belt tongues 9 can bear closely to the contour of the user's body 6.

The areas 13 of belt tongues 9 are loosely overtaken from loops 15, which are connected, i.e. sewn, at an obtuse angle, to the buckle proximate ends 20 of the crotch belts 4. The area of connection is referenced with 21.

FIG. 1 illustrates only one belt segment 5 of pelvis belt 3 with their respective belt tongue 9, as well as crotch belt 4 with loop 15. The second belt segment 5 of pelvis belt 3 as well as the second crotch belt 4 with loop 15, with the exception of belt tongue 9, are shown for simplicity sake only in broken lines.

| List of Reference Numerals |
|---|
| 1 harness belt |
| 2 shoulder belts |
| 3 pelvis belt |
| 4 crotch belts |
| 5 belt segments of 3 |
| 6 body |
| 7 belt buckle |
| 8 belt tongues of 2 |
| 9 belt tongues of 5 |
| 10 locking ends of 9 |
| 11 recesses in 7 |
| 12 double arrow |
| 13 area betw. 10 and 14 |
| 14 brace 9 to 5 |
| 15 loops of 4 |
| 16 extensions of 9 |
| 17 ends of 5 |
| 18 gripping recesses |
| 19 slots in 9 |
| 20 ends of 4 |
| 21 connection area of 4 and 15 |
| , angle between 20 and 15 |

What is claimed is:

1. A harness belt for use as a personal retaining device comprising:

dual pelvis belts and a pair of shoulder belts secured to a central buckle, a crotch belt connected to each of the pelvis belts, the pelvis and shoulder belts include belt segments, said segments secured at a buckle proximate end thereof to a belt tongue, wherein the belt tongue associated with each pelvis belt extends from a belt segment proximate end to a catch end in a tapered configuration, each crotch belt is secured to the belt tongue associated with the respective pelvis belt by means of a belt loop secured to a buckle proximate end of the crotch belt under an obtuse angle open towards the belt buckle for firmly retaining the loop at the tapered portion of the belt tongue; and wherein the catch end of the belt tongue is adapted for fitting into a corresponding recess of the buckle when the catch end is inserted into the buckle which is thereby secured against movement in circumferential direction.

2. The harness belt of claim 1, wherein the buckle proximate end of the belt tongues of the belt segments of the pelvis belts are provided with gripping recesses.

3. The harness of claim 1, wherein the catch end has a triangular configuration conforming to a corresponding recess in the buckle for secure connection to the buckle.

4. The harness of claim 1, wherein the segment proximate end of the belt tongues have attachment means for the belt segment that are configured for attachment of the belt segments along substantially their entire width.

5. The harness of claim 1, wherein the belt segment proximate end of the belt tongue is provided with slots to reduce the weight of the belt tongues.

6. The harness of claim 1, wherein the tapered section of the belt tongue associated with each of the pelvis belts has a stepped configuration relative to the transverse of the normal to thereby bear closely to a wearer's body.

7. The harness of claim 1, wherein the belt tongues associated with the pelvis belts are configured for connecting ends of the belt segments of the pelvis belt so as to be substantially rotationally secured against twisting and tilting.

* * * * *